US008831247B2

(12) United States Patent
Akino

(10) Patent No.: US 8,831,247 B2
(45) Date of Patent: Sep. 9, 2014

(54) PHANTOM POWER CIRCUIT

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 363 days.

(21) Appl. No.: 13/242,150

(22) Filed: Sep. 23, 2011

(65) Prior Publication Data

US 2012/0076325 A1 Mar. 29, 2012

(30) Foreign Application Priority Data

Sep. 29, 2010 (JP) ..... 2010-218579

(51) Int. Cl.
*H04R 3/00* (2006.01)
*H04R 1/04* (2006.01)
*H04R 19/04* (2006.01)

(52) U.S. Cl.
CPC *H04R 3/007* (2013.01); *H04R 1/04* (2013.01); *H04R 19/04* (2013.01)
USPC ..... 381/113; 381/28; 381/323; 381/92; 381/94.5

(58) Field of Classification Search
USPC ..... 381/113, 111, 14, 26, 28, 323, 74, 77, 381/78, 79, 84, 91, 92, 94.5, 94.6, 95, 120, 381/122, 123
See application file for complete search history.

(56) References Cited

U.S. PATENT DOCUMENTS

2006/0062406 A1* 3/2006 Kinoshita ..... 381/113
2007/0230717 A1* 10/2007 Akino ..... 381/113

FOREIGN PATENT DOCUMENTS

JP 2009-290639 12/2009

* cited by examiner

*Primary Examiner* — Leshui Zhang
(74) *Attorney, Agent, or Firm* — Whitham Curtis Christofferson & Cook, PC

(57) ABSTRACT

A phantom power circuit has a detection circuit and a limiting circuit, the detection circuit detecting a pulse current generated in association with connection or disconnection of a condenser microphone, the limiting circuit limiting the output of the condenser microphone. The detection circuit detects a pulse current generated between input terminals of the condenser microphone. The limiting circuit reduces the output from the condenser microphone when the detection circuit detects the pulse current.

18 Claims, 1 Drawing Sheet

PHANTOM POWER CIRCUIT

BACKGROUND OF THE INVENTION

1. Field of the Invention

The present invention relates to a phantom power circuit included in a condenser microphone, more specifically a phantom power circuit automatically limiting the output of a pulse current generated in association with connection or disconnection of a condenser microphone.

2. Related Background Art

Power supply systems for condenser microphones and other microphones are set forth in the EIAJ standard (RC-8162A). The EIAJ standard, which pertains to a phantom power source, defines three types of supply voltages (12 V, 24 V, and 48V).

The phantom power source is a DC power supply. To supply power, a DC voltage is applied to input terminals (HOT terminal and COLD terminal) of a condenser microphone through supply resistors. The voltage of the same level is applied to the HOT terminal and the COLD terminal. Unless the both terminals (HOT terminal and COLD terminal) of the condenser microphone are connected or disconnected simultaneously to and from the phantom power source, a rush current, which is a pulse-shaped current, occurs even if it is momentarily.

With generation of such a pulse current, sound associated with the pulse current is output to an output device connected through the phantom power source for outputting sound input from the condenser microphone. The output sound resembles an impact sound. Such output sound after being amplified through an amplifier generates a loud and uncomfortable popping sound, which may also damage the output device.

Such a pulse current is not generated if the condenser microphone and the phantom power source are connected or disconnected in a state where the switch of the condenser microphone or the switch of the phantom power source is turned off. In the actual use, however, the condenser microphone and the phantom power source are connected or disconnected without switching off, in order to enhance work efficiency. Under the circumstances, a phantom power source is demanded that automatically limits the output of a pulse current and operates in a normal mode with no pulse current generated.

Although no related art literature has been found intended to automatically limit the output of a pulse current associated with connection or disconnection of a condenser microphone in a phantom power circuit, Japanese Unexamined Patent Application Publication No. 2009-290639 discloses technology pertaining to the present invention.

The invention disclosed in Japanese Unexamined Patent Application Publication No. 2009-290639 is directed to a method of connecting a tubular body that can be used as a connector housing of a condenser microphone unit. A zener diode element for blocking overcurrent is provided on a circuit board accommodated in the connector housing.

SUMMARY OF THE INVENTION

In view of the circumstances above, an object of the present invention is to provide a phantom power circuit included in a condenser microphone, more specifically a phantom power circuit automatically limiting the output of a pulse current generated in association with connection or disconnection of a condenser microphone and operating in a normal mode with no pulse current generated.

The present invention provides a phantom power circuit supplying power to a condenser microphone through two supply resistors, the phantom power circuit including a detection circuit detecting a pulse current generated in association with connection or disconnection of terminals of the condenser microphone to or from respective terminals of the phantom power circuit and a limiting circuit limiting output of the condenser microphone. The detection circuit detects the pulse current generated between the terminals, to be connected to the terminals of the condenser microphone, of the condenser microphone. The limiting circuit reduces the output of the condenser microphone when the detection circuit detects the pulse current.

According to the present invention, uncomfortable sound, including a popping sound, due to the pulse current generated in association with connection or disconnection of the condenser microphone can be prevented from being output from an output device.

Even if a connection or disconnection is made without turning off the switch of the condenser microphone, uncomfortable sound is not output, thus eliminating extra work during operation.

DESCRIPTION OF THE PREFERRED EMBODIMENTS

Figure 1:
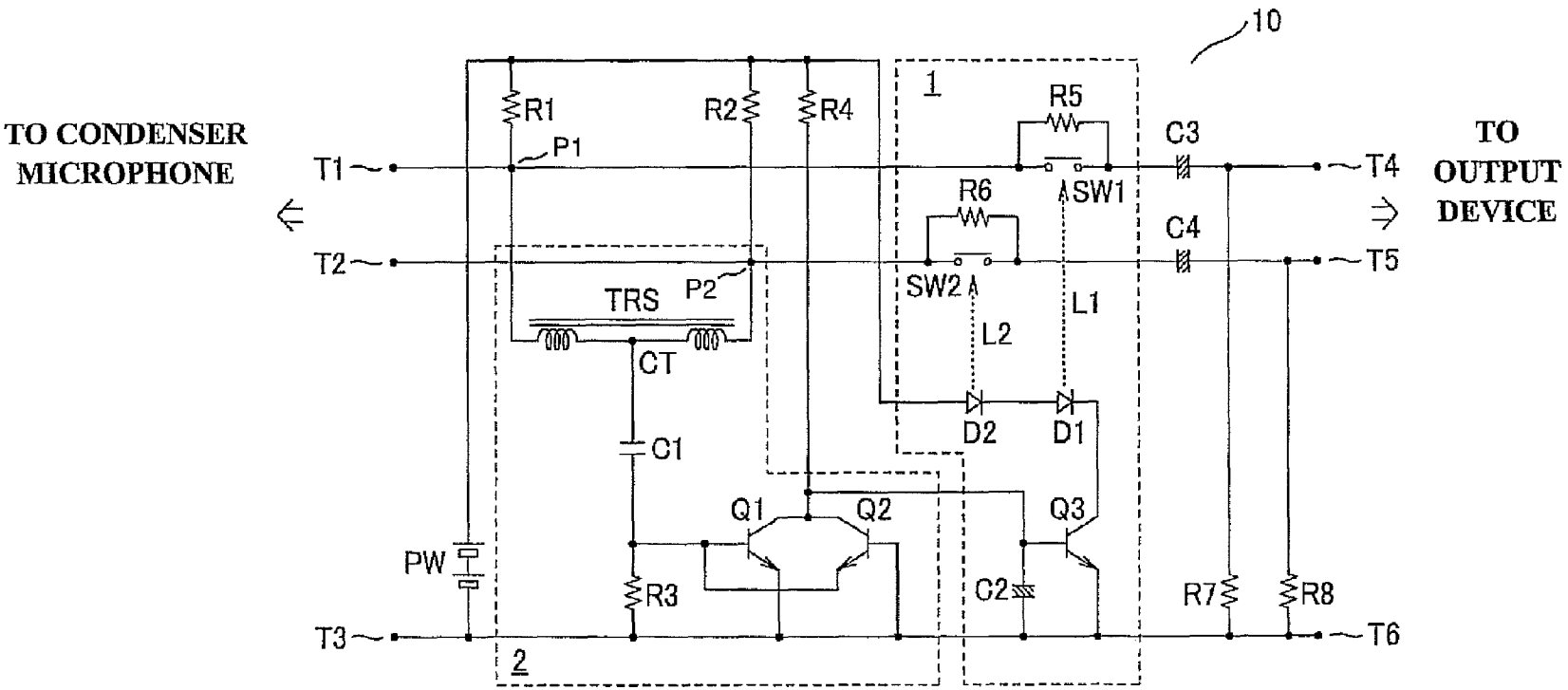
FIG. 1 is a circuit diagram of a phantom power circuit according to an embodiment of the present invention.

A phantom power circuit according to an embodiment of the present invention is explained with reference to FIG. 1. FIG. 1 is a circuit diagram of the phantom power circuit according to the embodiment of the present invention. A phantom power circuit 10 includes a power source PW that supplies DC power and supply resistors R1 and R2 between terminals (T1, T2, and T3) connected to a condenser microphone (not shown in the drawing) and terminals (T4, T5, and T6) connected to an output device (e.g., an amplifier). Furthermore, a limiting circuit 1 and a detection circuit 2 are provided, which are characteristic of the phantom power circuit of the present invention.

The terminal T1 is connected to a HOT terminal of the condenser microphone (not shown in the drawing). The terminal T2 is connected to a COLD terminal of the condenser microphone. The terminal T3 is connected to a ground terminal. The power is supplied from the power source PW to the condenser microphone through the supply resistor R1, which is connected to the terminal T1, and the supply resistor R2, which is connected to the terminal T2. In the case of a power source voltage of 48 V, for example, the voltage applied to between the terminals T1 and T2 is 48 V.

The terminal T4, which is the connection terminal of the output device, is connected to the HOT terminal of the condenser microphone. The terminal T5 is connected to the COLD terminal of the condenser microphone. The terminal T6 is connected to a ground terminal.

The limiting circuit 1 is provided between the terminals T1 and T4 and between the terminals T2 and T5. The limiting circuit 1 operates so as to automatically limit the signal output to the output device in response to generation of a pulse current, as described hereinafter. The detection circuit 2 detects a pulse current, which is mainly generated in association with connection or disconnection of the condenser microphone, and then operates the limiting circuit 1.

The detection circuit 2 is described below. In FIG. 1, the detection circuit 2 has a transformer TRS, a capacitor C1, a resistor R3, and transistors Q1 and Q2.

The transformer TRS is connected to the power supply line of the terminal T1 and the power supply line of the terminal T2, to both of which the condenser microphone is connected. In other words, the transformer TRS connects the terminals T1 and T2. In FIG. 1, the node of the terminal T1 and the transformer TRS is P1, and the node of the terminal T2 and the transformer TRS is P2. The transformer TRS is a bifilar winding transformer and is provided with a center tap CT. The transformer TRS operates as a choke coil with alternate current, thus causing no load on the condenser microphone.

The center tap CT of the transformer TRS is connected in series to the capacitor C1 and the resistor R3, which are connected to the ground terminal T3. The capacitor C1 and the resistor R3 form a differentiating circuit, in which the center tap CT is an input terminal and the node of the capacitor C1 and the resistor R3 is an output terminal.

With a DC voltage applied to the two ends (P1 and P2) of the transformer TRS through the supply resistors R1 and R2, no potential difference is generated between P1 and P2, provided the same load is connected to the terminals T1 and T2. Thus, the terminals T1 and T2 are in an equilibrium state having substantially the same potential. In the equilibrium state, no current flows to the transformer TRS. However, in the case of connecting or disconnecting the condenser microphone, or in the case of connecting (disconnecting) either of the terminal T1 or T2 prior to the other, the equilibrium state is instantly lost between the terminals, causing a pulse current to flow from P1 to P2 or from P2 to P1. The polarity of the pulse current is different depending on at which of P1 and P2 potential is reduced. In other words, the polarity of the current depends on which of the terminals T1 and T2 is earlier connected to or disconnected from the terminal of the condenser microphone.

The pulse current is input through the center tap CT to the differentiating circuit composed of the capacitor C1 and the resistor R3. The pulse current is then input from the output end, which is the node of the capacitor C1 and the resistor R3, to a first transistor circuit composed of the transistors Q1 and Q2.

The output from the differentiating circuit flows to the base of the transistor Q1 and the emitter of the transistor Q2 in the first transistor circuit. In other words, the base potential of the transistor Q1 and the emitter potential of the transistor Q2 are configured to vary with the pulse current. The positive output from the differentiating circuit increases the base potential of the transistor Q1, thus turning on the transistor Q1. In this state, the emitter potential of the transistor Q2 is higher than the base potential of the transistor Q2, thus leaving the transistor Q2 in the off state.

The negative output from the differentiating circuit decreases the base potential of the transistor Q1, thus leaving the transistor Q1 in the off state. With the decrease in the emitter potential of the transistor Q2, however, the base potential of the transistor Q2 is relatively higher than the emitter potential, thus turning on the transistor Q2. Thereby, generation of the pulse current turns on either of the transistor Q1 or Q2.

In the detection circuit 2 having the configuration described above, the two transistors Q1 and Q2 included in the first transistor circuit are turned on from the off state by the pulse current generated in association with connection or disconnection of the terminals of the condenser microphone to or from the terminals of the phantom power source. Thereby, generation of the pulse current can be detected. In a state where no pulse current is generated (equilibrium state), the base of the transistor Q1 and the emitter of the transistor Q2 are both grounded through the resistor R3 and the transistors Q1 and Q2 are in the off state.

The limiting circuit 1 is described below. The limiting circuit 1 includes a second transistor circuit composed of a capacitor C2 and a transistor Q3, light-emitting elements D1 and D2, photo-MOS relays SW1 and SW2, and resistors R5 and R6.

The base of the transistor Q3 is connected to the collectors of the transistors Q1 and Q2 included in the first transistor circuit. The capacitor C2 is connected to the base of the transistor Q3. The capacitor C2 is charged through the resistor R4. This charge maintains the base potential of the transistor Q3 at a predetermined value. Specifically, the transistor Q3 is in the on state in a normal mode. With no input from the collectors of the transistors Q1 and Q2 (i.e., both the transistors Q1 and Q2 remain in the off state), the transistor Q3 remains in the on state and a current flows to the light-emitting elements D1 and D2 from the power source PW through the resistor R4 for light emission.

The photo-MOS relay SW1 closes a node in response to light L1 emitted from the light-emitting element D1. The photo-MOS relay SW2 closes a node in response to light L2 emitted from the light-emitting element D2. Specifically, the nodes of the photo-MOS relays SW1 and SW2 are closed during the state where the transistor Q3 is on. Thus, signals from the condenser microphone are output to the output device.

Generation of a pulse current turns on either of the transistor Q1 or Q2. The capacitor C2 connected to the collectors of the transistors Q1 and Q2 is then short-circuited and discharges. The discharge from the capacitor C2 reduces the base potential of the transistor Q3 to substantially ground potential. This turns off the transistor Q3 and no current flows to the light-emitting elements D1 and D2. In other words, generation of the pulse current turns off the light-emitting elements D1 and D2.

Then, both the photo-MOS relays SW1 and SW2 open the nodes, allowing the output to flow toward the terminal T4 through the resistor R5 and to flow toward the terminal T5 through the resistor R6.

Specifically, when the pulse current is detected which is generated in association with the connection or disconnection of the connection terminals of the condenser microphone to or from the terminals T1 and T2 of the phantom power circuit 10, the condenser microphone is connected to the output device through the resistors R5 and R6. The output from the condenser microphone is then attenuated (reduced) by the resistors R5 and R6. Accordingly, the limiting circuit 1 and the detection circuit 2 attenuate (reduce) the output associated with the pulse current, thus preventing a sudden large output from being directed to the output device.

In other words, in response to detection of the pulse current, the photo-MOS relays SW1 and SW2 operate such that the output circuit of the condenser microphone is automatically switched for the output through the resistors R5 and R6, thus preventing the output of the condenser microphone. This prevents the output of the pulse current directly to the output device.

As described above, the phantom power circuit of the present invention automatically prevents the pulse current generated in association with the connection of the condenser microphone from flowing to the output device and operates as a normal phantom power circuit during normal use.

Use of the power circuit of the present invention prevents damage to an output circuit even if a power source is hot-plugged, thus providing a condenser microphone with ease of maintenance.

What is claimed is:

1. A phantom power circuit supplying a power to a condenser microphone through terminals of the phantom power circuit, the phantom power circuit comprising:

a detection circuit that detects a pulse current generated upon connections or disconnections of terminals of the condenser microphone being not made simultaneously to or from respective terminals of the phantom power circuit; and a limiting circuit that reduces an output of the terminals of the condenser microphone, wherein the pulse current being generated between the terminals of the phantom power circuit, and the limiting circuit reduces the output from the terminals of the condenser microphone when the detection circuit detects the pulse current.

2. The phantom power circuit according to claim 1, wherein the detection circuit comprises:

a transformer that has two ends connected to two power supply lines that supply the power to the condenser microphone;

a differentiating circuit that reads and differentiates the detected pulse current from a middle point of the transformer to produce an output; and a first transistor circuit that is turned on by the output of the differentiating circuit.

3. The phantom power circuit according to claim 2, wherein the limiting circuit comprises:

a second transistor circuit that is turned off when the detection circuit detects the pulse current;

a light-emitting element that emits light in response to a state of the second transistor circuit; and an active element that operates in response to light emission of the light-emitting element.

4. The phantom power circuit according to claim 2, wherein the transformer is a bifilar winding transformer.

5. The phantom power circuit according to claim 3, wherein the active element is a photo-MOS relay and a node thereof is opened or closed in response to the light emission of the light-emitting element.

6. The phantom power circuit according to claim 1, wherein the limiting circuit comprises:

a transistor circuit that is turned off when the detection circuit detects the pulse current;

a light-emitting element that emits light in response to a state of the transistor circuit; and an active element that operates in response to light emission of the light-emitting element.

7. A phantom power circuit supplying a power to a condenser microphone, the phantom power circuit comprising:

a hot terminal that is connectable to the condenser microphone;

a cold terminal that is connectable to the condenser microphone;

a detection circuit that detects a pulse current between the hot terminal and the cold terminal upon the hot terminal and the cold terminal being not simultaneously connected to or disconnected with the condenser microphone, and does not detect the pulse current between the hot terminal and the cold terminal upon the hot terminal and the cold terminal being simultaneously connected to or disconnected with the condenser microphone; and a limiting circuit that reduces an output from the condenser microphone when the detection circuit detects the pulse current, and does not reduce the output of the condenser microphone when the detection circuit does not detect the pulse current.

8. The phantom power circuit according to claim 7, wherein the detection circuit comprises:

a transformer that has two ends connected to two power supply lines that supply the power to the condenser microphone;

a differentiating circuit that reads and differentiates the detected pulse current from a middle point of the transformer to produce an output; and a first transistor circuit that is turned on by the output of the differentiating circuit.

9. The phantom power circuit according to claim 8, wherein the limiting circuit comprises:

a second transistor circuit that is turned off when the detection circuit detects the pulse current;

a light-emitting element that emits light in response to a state of the second transistor circuit; and an active element that operates in response to light emission of the light-emitting element.

10. The phantom power circuit according to claim 8, wherein the transformer is a bifilar winding transformer.

11. The phantom power circuit according to claim 9, wherein the active element is a photo-MOS relay and a node thereof is opened or closed in response to the light emission of the light-emitting element.

12. The phantom power circuit according to claim 7, wherein the limiting circuit comprises:

a transistor circuit that is turned off when the detection circuit detects the pulse current;

a light-emitting element that emits light in response to a state of the transistor circuit; and an active element that operates in response to light emission of the light-emitting element.

13. A phantom power circuit supplying a power to a condenser microphone through terminals of the condenser microphone, the phantom power circuit comprising:

a hot terminal and a cold terminal;

a detection circuit that includes a transformer connected to both the hot terminal and the cold terminal, wherein no current flows to the transformer when the hot terminal and the cold terminal have substantially the same potential, wherein the detection circuit detects a pulse current flowing to the transformer upon a connection or disconnection of either the hot terminal or the cold terminal but not a simultaneous connection or disconnection of both the hot terminal and cold terminal from the terminals of the condenser microphone; and a limiting circuit that reduces an output from the condenser microphone when the detection circuit detects the pulse current.

14. The phantom power circuit according to claim 13, wherein the detection circuit further includes:

a differentiating circuit that reads and differentiates the detected pulse current from a middle point of the transformer to produce an output; and a first transistor circuit that is turned on by the output of the differentiating circuit.

15. The phantom power circuit according to claim 14, wherein the limiting circuit comprises:

a second transistor circuit that is turned off when the detection circuit detects the pulse current;

a light-emitting element that emits light in response to a state of the second transistor circuit; and an active element that operates in response to light emission of the light-emitting element.

16. The phantom power circuit according to claim 14, wherein the transformer is a bifilar winding transformer.

17. The phantom power circuit according to claim 15, wherein the active element is a photo-MOS relay and a node thereof is opened or closed in response to the light emission of the light-emitting element.

18. The phantom power circuit according to claim 13, wherein the limiting circuit comprises:

a transistor circuit that is turned off when the detection circuit detects the pulse current;

a light-emitting element that emits light in response to a state of the transistor circuit; and an active element that operates in response to light emission of the light-emitting element.

* * * * *